United States Patent [19]

Wiener et al.

[11] 4,128,583

[45] Dec. 5, 1978

[54] DIFLUORAMINO COMPOUNDS

[75] Inventors: Charles Wiener, Middletown, N.Y.; William E. Tyler, III, New Providence, N.J.

[73] Assignee: Exxon Research & Engineering Co., Florham Park, N.J.

[21] Appl. No.: 540,142

[22] Filed: Mar. 29, 1966

[51] Int. Cl.[2] ..... C07C 93/00

[52] U.S. Cl. ..... 260/584 C; 149/92

[58] Field of Search ..... 260/584, 564, 584 C; 149/92

[56] References Cited

U.S. PATENT DOCUMENTS 3,110,640 11/1963 Gey et al. ..... 149/92

3,228,936 1/1966 Davis et al. ..... 260/564 X

*Primary Examiner*—Leland A. Sebastian

*Attorney, Agent, or Firm*—Henry Berk; Jack Matalon

EXEMPLARY CLAIM

1. A compound comprising

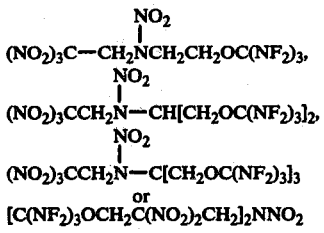

1 Claim, No Drawings

DIFLUORAMINO COMPOUNDS

This invention was made and/or reduced to practice in the performance of Contract No. DA-30-069-ORD-2487 entered into on Dec. 1, 1958 with the Department of the Army. The Government of the United States holds an irrevocable, non-exclusive, and royalty-free license to practice, and cause to be practiced by and for the Government throughout the world, in the manufacture, use and disposition according to law, any article, material, or method embodied in any and all of the inventions disclosed in this patent application, as well as in any and all Letters Patent, for the full term or terms thereof, which may eventuate from or be based thereon.

This invention relates to new solid oxidizers useful in solid rocket propellants. These solid oxidizers have high contents of nitro groups and of difluoramino groups and are exemplified by the organic nitramine called tris(difluoramino)methoxy-5,5,5-trinitro-3-nitraza-pentane. This compound, termed FA-TNENE, has been isolated and identified as having the following structural composition:

$$(NO_2)_3C—CH_2—N(NO_2)—CH_2CH_2—OC(NF_2)_3$$

In preparing composites of solid rocket propellants, the high-energy ingredients are binders, plasticizers, oxidizers, and oxidizable fuel substances. The binders, plasticizers and oxidizers may contain hydrogen and carbon as fuel constituents and are generally to be mixed with finely divided metals or metalloids which act as fuel ingredients. For propellants to have the high specific impulse value, e.g., substantially above 270, organic oxidizer ingredients containing hydrogen and carbon should contain a high proportion of oxidizing groups. In addition to the energy value of an oxidizer, there are a number of other characteristics which have to be evaluated to determine if it is a suitable improvement over existing ingredients, e.g., such characteristics as volatility, thermostability, sensitivity, compatability, and various effects in the propellant composite. The oxidizer compound should be obtainable in good yields without difficulties in its manufacture, purification, or blending with the other ingredients.

According to the present invention, the new solid oxidizer termed FA-TNENE has been successfully produced in satisfactory yields, purified and found to be useful in its evaluated characteristics as a solid oxidizer ingredient of a solid propellant. This compound is a fluorinated perfluoroguanadine adduct of trinitroethylnitraminoethanol, which also can be given the nomenclature 5,5,5-trinitro-3-nitraza-pentane-1-ol.

The new solid oxidizer FA-TNENE (III) has now been prepared by reaction of trinitroethylnitraminoethanol (I) with perfluoroguanadine (PFG) (II) followed by fluorination. The reaction is represented as follows:

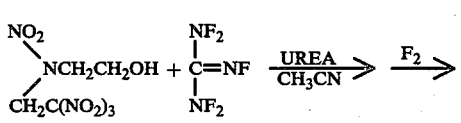

I II

-continued

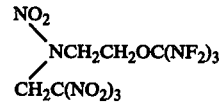

III

The following example and data illustrate a satisfactory method for the production and purification of FA-TNENE and test results on its properties.

EXAMPLE I

To a 50 cc glass reactor, equipped with a Fisher-Porter valve, was added 3.8 gm (14 mmoles) of N-trinitroethyl nitraminoethanol (m.p. 72° C.), 20 mg. of urea, 7 ml of $CH_3CN$ and 6 gm (44 mmoles) of PFG. The reaction was stirred overnight at room temperature. After removal of the excess PFG the product was fluorinated at −10° by passing a 20% $F_2$ in $N_2$ stream at 80 cc/min. over the solution for 5 hrs. The solvent was removed in a stream of dry $N_2$, to yield 4.9 gm of crude product (81% of theory).

Purification was accomplished by chromatography in two portions on a column 60 cm × 1 cm packed with silica gel. Elution was with 25–75 v/v hexane-$CHCl_3$ taking 2 cc cuts. The pure product was found in the early cuts and isolated by removing the solvent in a stream of dry $N_2$ to yield a total of 1.5 gm of white solid m.p. 109°–110° (25% of theory).

The structure was assigned on the basis of elemental analysis, IR, NMR, and method of preparation.

| IDENTIFICATION | | |
|---|---|---|
| Elemental Analysis | Found | Calc for $C_5H_6F_6N_8O_9$ |
| C | 13.9 | 13.8 |
| N | 25.7 (Dumans) | 25.8 |
| F | 26.1 | 26.2 |

The chemical analysis, the nuclear magnetic resonance (NMR) and infrared (IR) analysis showed that the purified product has the assigned structure and composition set forth for the compound called FA-TNENE.

Significant physical characteristics of the purified FA-TNENE product are as follows:

Thermal Stability

By heat treating and degassing prior to testing, a high stability was observed as measured by cc of gas generated per gram of sample at 60° C. and 100 hours. A sample tested formed only 0.35 cc per gram.

Impact Sensitivity

Based on sensitivity data including impact sensitivity, spark sensitivity, friction sensitivity, and auto-ignition, FA-TNENE was found to be one of the least sensitive and most easily handled compounds of its type and even better in these respects than nitroglycerin or hydrazine nitroform.

Differential Thermal Analysis

FA-TNENE shows slow decomposition up to a temperature of 200° C.

Solubility

FA-TNENE has been found to be soluble in various liquid oxidizers which can be used as plasticizers, e.g., such as a fluorinated PFG adduct of 2,3-dinitrato butane-1,4-diol, hexakis($NF_2$)propylether, also in nitroglycerine.

Burning Tests

FA-TNENE containing propellant strands was burned without detonation upon ignition. Double base propellants containing FA-TNENE are castable and have an Isp above 270, which varies depending on exact chemical compositions. The composites are relatively insensitive and have been made with tensile strengths of 120 psi. In making up these composites various nitrate containing plasticizers were used singly or in combinations with nitrates from among the compounds: ethylene glycol dinitrate, trimethylolethane trinitrate, di-(ethylene glycol dinitrate), and 1,2,4-butane triol trinitrate was particularly attractive for low volatility.

The formulations were bulk cured at 50° C. for various periods, e.g., up to 16 hours, followed by strand loading at 75° C. to give excellent strands which were fired under pressures up to 1200 psi and tested for burning rates. Typical formulations in making the strands contained 10 wt.% cellulose nitrate (12.6% N), 2 wt.% succinonitrile, 38 wt.% 1,2,4-trinitratobutane, 40 wt.% FA-TNENE, 9 wt.% aluminum powder and 1 wt.% zirconium powder.

Formulations which had very good burning properties and other desired physical properties are set forth as follows:

TABLE I

| SOLID PROPELLANT FORMULATIONS | | | | |
|---|---|---|---|---|
| Ingredients | Wt. % | | Wt. % | |
| Liquid Oxidizer, TVOPA[1] | 35.9 | FA-PETRIN[4] | 33.3 | FA-PETRIN |
| Polymer HPVA[2] | 2.9 | HPVA | 2.6 | HPVA |
| PAPI[3] | 1.2 | PAPI | 1.1 | PAPI |
| Solid Oxidizer FA-TNENE | 55.5 | FA-TNENE | 60.5 | FA-TNENE |
| Fuel, Boron | 4.5 | B | 2.5 | B |

[1] 1,2,3-tris[α,β-bis($NF_2$)ethoxy]propane
[2] Poly vinyl acetate, 70% hydrolyzed
[3] Poly aryl poly isocyanate crosslinking agent
[4] Fluorinated $(NF_2)_3COCH_2C(CH_2ONO_2)_3$ These formulations have Isp values of 281 to 286. The formulations were cured at 25° C. for 5 days.

The chemistry which leads to the formation of the solid oxidizer FA-TNENE, a nitramine containing three difluoroamino groups and four nitrato groups, was extended to produce similar solid oxidizers having higher energy contents in terms of difluoramino groups per carbon atom in the molecule.

The members of the solid nitramine family represented as follows:

FA-TNENE $$(NO_2)_3C-CH_2\overset{NO_2}{\overset{|}{N}}CH_2CH_2OC(NF_2)_3$$

FA-TNEND $$(NO_2)_3CCH_2\overset{NO_2}{\overset{|}{N}}-CH[CH_2OC(NF_2)_3]_2$$

FA-TNENT $$(NO_2)_3CCH_2\overset{NO_2}{\overset{|}{N}}-C[CH_2OC(NF_2)_3]_3$$

FA-PNAHD $$[C(NF_2)_3OCH_2C(NO_2)_2CH_2]_2NNO_2$$

FA-TNEND, the second member of the family, is prepared by a synthesis similar to that for FA-TNENE. The third and fourth members have been found more difficult to prepare in suitable yields by the same synthetic route but their energy values should be high. Synthesis and evaluation of FA-TNEND is given in the following example.

EXAMPLE II

Synthesis of FA-TNEND

A mixture of 1.85 g. (6.2 mmoles) of trinitroethylnitraminopropane 1,3-diol, 100 mg. of urea, and 10 cc of acetonitrile was contacted with 6 g. of PFG for 48 hours. The cloudy, orange colored mixture which resulted was fluorinated for 4 hours at 80 cc/min. with 20% $F_2$ in $N_2$ at −10° C. After removal of the acetonitrile, the material was dissolved in methylene chloride and dried over $MgSO_4$. Filtration and removal of the solvent afforded 3.3 g. (85%) of crude FA-TNEND. This material was purified by rapid passage through a column containing 50 g. of silica gel (Grace #923). The recovery was 1.5 g. (45%). Further purification may be achieved by taking narrower chromatography cuts or by sublimation. FA-TNEND appears to decompose on standing in the presence of silica gel.

The m.p. of pure FA-TNEND is 97°–98° C.

Identification

Analysis: Calc. for $C_7H_7N_{11}O_{10}F_{12}$: %C = 13.3; %N = 24.4; %F = 35.1. Found: %C = 13.00; %N = 25.94; %F = 36.00.

The assigned structure was consistent with IR and NMR analysis. FA-TNEND used in formulations similar to those shown for the use of FA-TNENE give an Isp of 290. The close relationship of these compounds is shown in the following table:

TABLE II

| | FA-TNEND | FA-TNENE |
|---|---|---|
| M.P. | 97 – 98° C. | 109 – 110° C. |
| Impact Sensitivity | 13 Kg.-cm. | 3 – 35 Kg.-cm. |
| VTS (60° C.) | 0.35 cc/g. (100 hrs.) | 0.2 cc/g. (100 hrs.) |
| (90° C.) | 9.2 cc/g. (75 hrs.) | 9.2 cc/g. (100 hrs.) |

VTS = Vacuum thermal stability

For the preparation of FA-TNENT, the compound to be used for forming the perfluoroguanadine adduct which is thereafter fluorinated has the formula:

$$(NO_2)_3CCH_2\overset{NO_2}{\overset{|}{N}}C(CH_2OH)_3$$

The fourth solid nitramine FA-PNAHD may be prepared by the reaction of perfluoroguanadine with 2,2,4,6,6-pentanitro-4-azaheptanediol-1,7 and with subsequent fluorination of the adduct. The resulting solid nitramine has an energy close to that of FA-TNEND.

As represented by the solid nitramine FA-TNENE, the solid nitramines have a high energetic source of $NF_2$ and of oxygen. Solid propellants containing as much as 60% by weight of the solid nitramine have been test fired successfully in rocket motors with 90 to 93.4% efficiency.

The process described is claimed as follows:

1. A compound comprising $$(NO_2)_3C-CH_2\overset{NO_2}{\overset{|}{N}}CH_2CH_2OC(NF_2)_3,$$

$$(NO_2)_3CCH_2\overset{NO_2}{\overset{|}{N}}-CH[CH_2OC(NF_2)_3]_2,$$

$$(NO_2)_3CCH_2\overset{NO_2}{\overset{|}{N}}-C[CH_2OC(NF_2)_3]_3$$

or $$[C(NF_2)_3OCH_2C(NO_2)_2CH_2]_2NNO_2$$

* * * * *